US010526740B2

(12) United States Patent
Lv et al.

(10) Patent No.: US 10,526,740 B2
(45) Date of Patent: Jan. 7, 2020

(54) SELF-CLEANING DRUM WASHING MACHINE

(71) Applicant: QINGDAO HAIER DRUM WASHING MACHINE CO., LTD., Qingdao, Shandong (CN)

(72) Inventors: Peishi Lv, Shandong (CN); Sheng Xu, Shandong (CN); Zhenxing Huang, Shandong (CN); Xiuwen Peng, Shandong (CN)

(73) Assignee: QINGDAO HAIER DRUM WASHING MACHINE CO., LTD., Qingdao, Shandong (CN)

( * ) Notice: Subject to any disclaimer, the term of this patent is extended or adjusted under 35 U.S.C. 154(b) by 247 days.

(21) Appl. No.: 15/513,329

(22) PCT Filed: Nov. 14, 2014

(86) PCT No.: PCT/CN2014/091144
§ 371 (c)(1),
(2) Date: Mar. 22, 2017

(87) PCT Pub. No.: WO2016/049968
PCT Pub. Date: Apr. 7, 2016

(65) Prior Publication Data

US 2017/0298551 A1 Oct. 19, 2017

(30) Foreign Application Priority Data

Sep. 29, 2014 (CN) ..... 2014 1 0514790

(51) Int. Cl.
*D06F 37/26* (2006.01)
*D06F 39/08* (2006.01)
(Continued)

(52) U.S. Cl.
CPC ..... *D06F 35/00* (2013.01); *D06F 37/266* (2013.01); *D06F 39/085* (2013.01); *D06F 37/04* (2013.01); *D06F 39/04* (2013.01)

(58) Field of Classification Search
CPC ..... D06F 37/04; D06F 37/206; D06F 37/22
See application file for complete search history.

(56) References Cited

U.S. PATENT DOCUMENTS

2005/0279141 A1* 12/2005 Kim ..... D06F 39/04 68/12.22
2006/0179897 A1 8/2006 Saito et al.
(Continued)

FOREIGN PATENT DOCUMENTS

CN 101643994 A 2/2010
CN 201447585 U 5/2010
(Continued)

OTHER PUBLICATIONS

Extended European Search Report dated Apr. 10, 2018, issued by the European Patent Office in corresponding European Application No. 14903382.1. (9 pages).
(Continued)

*Primary Examiner* — Spencer E Bell
(74) *Attorney, Agent, or Firm* — Buchanan Ingersoll & Rooney PC

(57) ABSTRACT

A self-cleaning drum washing machine, comprises a coaxial drum and outer tub. Cleaning particles are arranged between the drum and the outer tub. Structures between the drum and the outer tub opposite to each other are smooth. A flange is fixedly connected to the bottom of the drum; the outer portion of the flange has a smooth structure or an enclosed cavity is arranged on the outer portion of the drum bottom; the flange is arranged in the cavity; a shaft hole is arranged at the center of the cavity; and a drum shaft sticks into the cavity through the shaft hole and is connected to the flange.
(Continued)

The smooth structures go against the attachment of dirt, so that the outer wall of the drum and the inner wall of the outer tub can be conveniently cleaned by the cleaning particles.

14 Claims, 3 Drawing Sheets

(51) Int. Cl.

| | |
|---|---|
| ***D06F 35/00*** | (2006.01) |
| *D06F 37/04* | (2006.01) |
| *D06F 39/04* | (2006.01) |

(56) References Cited

U.S. PATENT DOCUMENTS

| | | | | |
|---|---|---|---|---|
| 2012/0298157 | A1* | 11/2012 | Noh ..... | A47L 15/4244 134/57 R |
| 2013/0127263 | A1 | 5/2013 | Park | |
| 2015/0096333 | A1 | 4/2015 | Shu et al. | |

FOREIGN PATENT DOCUMENTS

| | | | |
|---|---|---|---|
| CN | 102234902 | A | 11/2011 |
| CN | 102357494 | A | 2/2012 |
| CN | 102733145 | A | 10/2012 |
| CN | 102733147 | A | 10/2012 |
| CN | 202865624 | U | 4/2013 |
| CN | 202865625 | U | 4/2013 |
| CN | 103820974 | A | 5/2014 |
| EP | 2 161 370 | A1 | 3/2010 |

OTHER PUBLICATIONS

International Search Report (PCT/ISA/210) dated Jul. 1, 2015, by the Chinese Patent Office as the International Searching Authority for International Application No. PCT/CN2014/091144.

Written Opinion (PCT/ISA/237) dated Jul. 1, 2015, by the Chinese Patent Office as the International Searching Authority for International Application No. PCT/CN2014/091144.

* cited by examiner

SELF-CLEANING DRUM WASHING MACHINE

FIELD OF THE INVENTION

The present disclosure relates generally to a field of a washing machine, and more particularly, to a self-cleaning drum washing machine.

BACKGROUND OF THE INVENTION

As people's living standards and the requirements of living quality increase, washing machine has gradually become one of essential home appliances, most people choose washing machines as a main tool for washing clothes. The washing machine makes clothes clean, at the same time, a lot of dirt deposited in the washing machine, especially on an outer wall of a drum and an inner wall of an outer tub. With the accumulation of time, the dirt is also accumulating more, which results in secondary pollution during a washing process. During the washing process of the washing machine, a lot of dirt dissolve in the washing water, and into the outer tub through the holes of the drum. Part of the dirt is deposited on the outer wall of the drum and the inner wall of the outer tub, especially a bottom of the inner and outer tubs. Due to uneven surface of the tubs and drum, it is easier to deposit dirt. Over time, the deposited dirt on the inner wall of the outer tub will be more and more, and during the next laundry, part of the dirt on the wall of the tubs will dissolve in the washing water, which causes secondary pollution for the washing water. Thus seriously affects the hygiene of the laundry.

Although the washing technology is developing rapidly, and has made great progress, but there is still no better solution to remove the deposited dirt in the outer tub of the washing machine. Most of the existing washing machines use the cleaner with the drum rotation to carry out a simple tub cleaning by water flowing and scouring, but that can only remove a small amount of the dirt on the walls of the inner and outer tubs.

Some washing machines are provided with a simple tub cleaning device, which needs manual installation and removal, and cannot clean the bottom of the inner and outer tubs, that is trouble to use.

A Chinese utility application No. 200920047205. X discloses a drum washing machine with a self-cleaning function, includes a shell of forming an outlook of the washing machine, an outer tub is provided inside the shell, a rotatable drum for washing clothes is provided in the outer tub. A door is installed on a front plate of the shell, a control panel that can regulate the operating sequence of the washing machine is provided above the front plate. A hole is arranged on the drum, the hole is provided with a cleaning means for washing an inner wall of the outer tub when the drum rotates. This drum washing machine has no blind corners in cleaning, and doesn't need to dismantle assemblies of the drum. The washing machine needs less washing water, but it cannot clean the dirt between a bottom of the drum and an inside of the outer tub bottom.

Some of the existing washing machines are provided with cleaning particles between the inner and outer tubs for cleaning the portion between the inner and outer tubs. But the flange is arranged at the bottom of the drum. The flange generally has a complex structure with more corners, which is easy to lock clean particles, and edges and corners are also likely to damage the clean particles.

In view of foregoing, the disclosure is proposed.

SUMMARY OF THE INVENTION

An object of the disclosure is to overcome the shortcomings of the prior art, and provides a drum of a self-cleaning washing machine and a washing machine.

In order to achieve the object, the present disclosure adopts the following technical schemes: A self-cleaning drum washing machine, at least comprises a drum and an outer tub which are coaxially arranged, cleaning particles are arranged between the drum and the outer tub. Structures between the drum and the outer tub opposite to each other are a smooth structure.

A flange is arranged at a bottom of the drum, the flange is fixedly connected to the drum; an outer side of the drum sidewall is a smooth structure, the outer portion of the flange is a smooth structure.

A flange is arranged at the bottom of the drum; the flange is fixedly connected to the drum. An outer portion of the bottom of the drum is provided with an enclosed cavity, the flange is arranged in the cavity, the outer wall of the cavity is a smooth structure.

The bottom of the drum is a nonporous structure, a groove which is recessed inside the drum, is arranged at the bottom of the drum, and the flange is arranged in the groove. A sealing plate is arranged at an opening of the groove, between the groove and the sealing plate is the enclosed cavity. A side of the sealing plate towards outside has a smooth plane or a smooth curved surface. Preferably, a shape of the groove is the same as a shape of the flange, an inner portion of the bottom of the drum has an inward bulge, which has a same shape with the flange.

The sealing plate is fixed to the flange by screws, or the flange and the sealing plate are integrally formed. Preferably, one end face of the flange extends into a flat plate to form the sealing plate. Preferably, a shaft hole matching with a drum shaft is arranged at a center of the sealing plate, and the drum shaft sticks into the cavity through the shaft hole and is connected to the flange.

The bottom of the drum is a nonporous structure, the outer portion of the drum bottom is a plane structure. The flange is arranged at the outer portion of the drum bottom, a basin-shaped shell is arranged on an outer portion of the flange. An opening of the shell is connected to the bottom of the drum in a seal way, between the shell and the bottom of the drum is the enclosed cavity. A shaft hole matching with a drum shaft is arranged at a center of the shell, and the drum shaft sticks into the cavity through the shaft hole and is connected to the flange.

A first sealing ring is arranged between the shaft hole and the drum shaft. A second sealing ring is arranged between the sealing plate or the shell and the bottom of drum.

An inner portion of the outer tub is a smooth plane or a smooth curved surface. Preferably, a heating tube chamber is arranged at a lowest portion inside the outer tub, the heating tube chamber is a groove recessed downwardly in a vertical direction. A heating tube is arranged in the groove, and a cover plate is arranged at an opening of the groove, a side of the cover plate towards the drum is a smooth plane or a smooth curved surface. Preferably, the cover plate is a metal plate with good thermal conductivity.

The cover plate is provided with an opening through which the interior of the outer tub is communicated with and the heating tube chamber. The cover plate extends downwardly smoothly from the opening to a position which has a distance from the bottom of the heating tube chamber. The distance is less than the minimum diameter of the cleaning particles.

A drainage port is arranged at the lowest portion of the heating tube chamber; the cover plate is located above the drainage port. A position of the opening on the cover plate corresponds to a position of the drainage port. The cover plate extends downwardly and smoothly from the opening to a position which has a distance from the drainage port. The distance is less than the minimum diameter of the cleaning particles.

By adopting the technical proposal of the disclosure, it brings the following beneficial effects:

1. The flange of the present disclosure is arranged in an enclosed cavity, and the sides between the bottom of the drum and the outer tub are smooth planes. That is not conducive to the adhesion of the dirt, avoids the formation of the dirt blind corners, and is easy for the cleaning particles to clean the outer wall of the drum and the inner wall of the outer tub.

2. The outer wall of the drum and the inner wall of the outer tub are cleaned by the cleaning particles between the drum and the outer tub of the present disclosure. When the drum rotating, the clean particles continue rubbing the outer wall of the drum and the inner wall of the outer tub. Thus can effectively prevent the deposition of dirt and keep clean of the inner and outer tubs, and will not cause secondary contamination for clothing. There is no need to detach the drum members, and it is easy to operate.

3. The heating tube chamber of the outer tub of the present disclosure is provided with a cover plate which effectively blocks the dirt from getting into the heating tube chamber. The cover plate also prevents the cleaning particles from entering the heating tube chamber and contacting with the heating tube. Thus can prevent the heating tube from being too high to cause damage to the cleaning particles, but also blocks the lint from getting into the heating tube chamber and wrapping around the heating tube, which could avoid the impact of the lint on the heating tube.

The following is further described in details with embodiments of the present disclosure.

Figure 1:
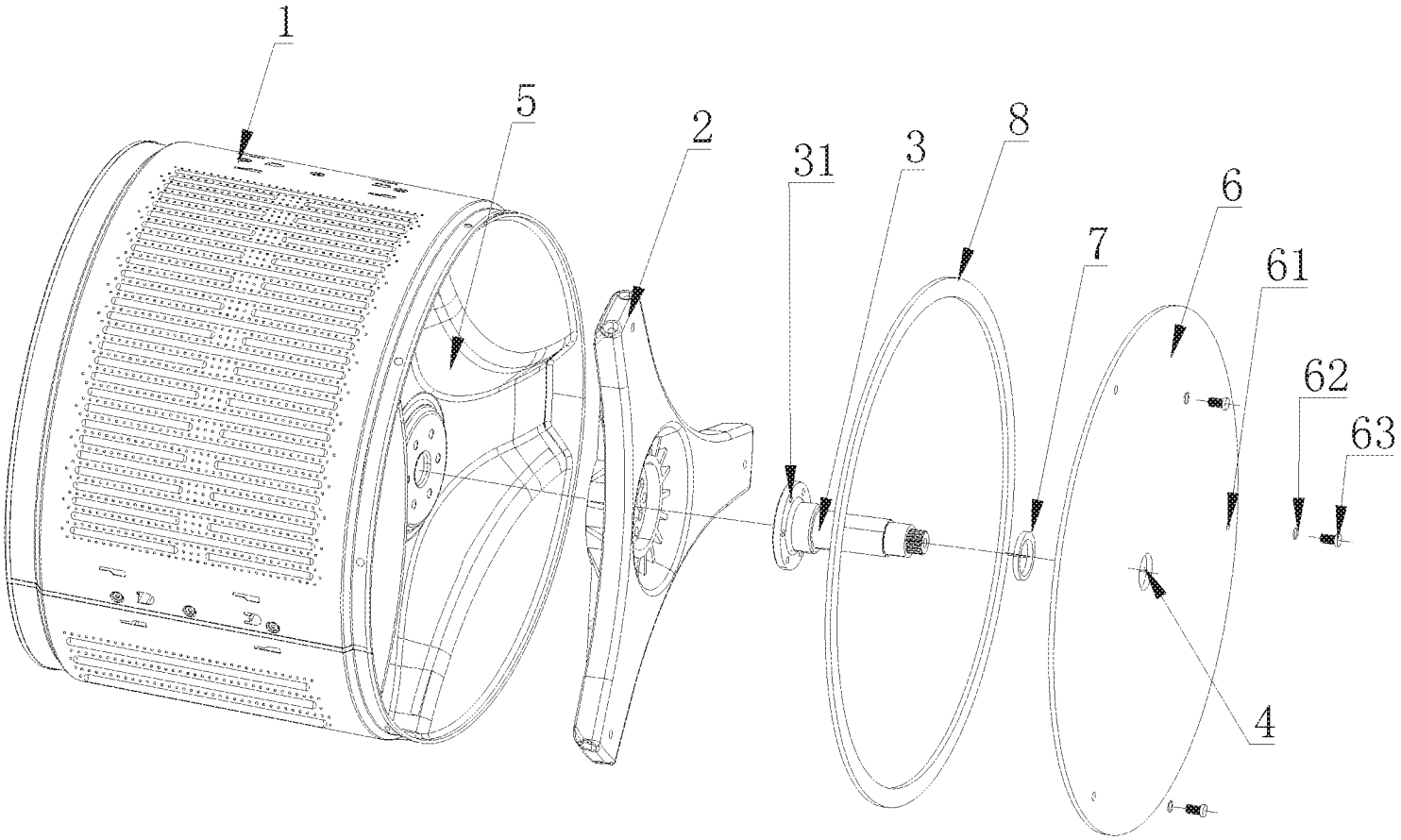
FIG. 1: An explosive view of the structure of a drum of the present disclosure.
Figure 2:
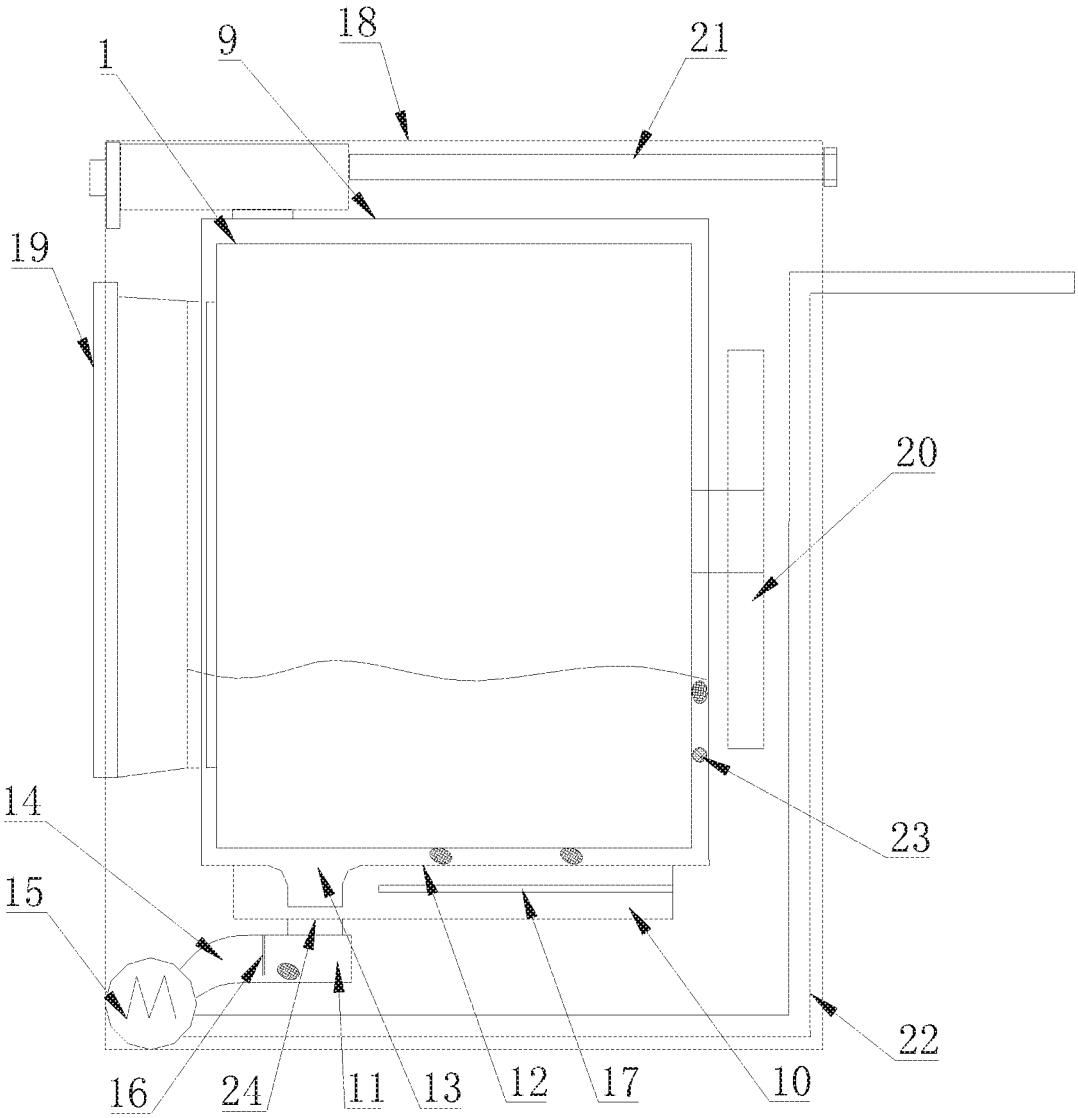
FIG. 2: A schematic diagram of the structure of a washing machine of the present disclosure.
Figure 3:
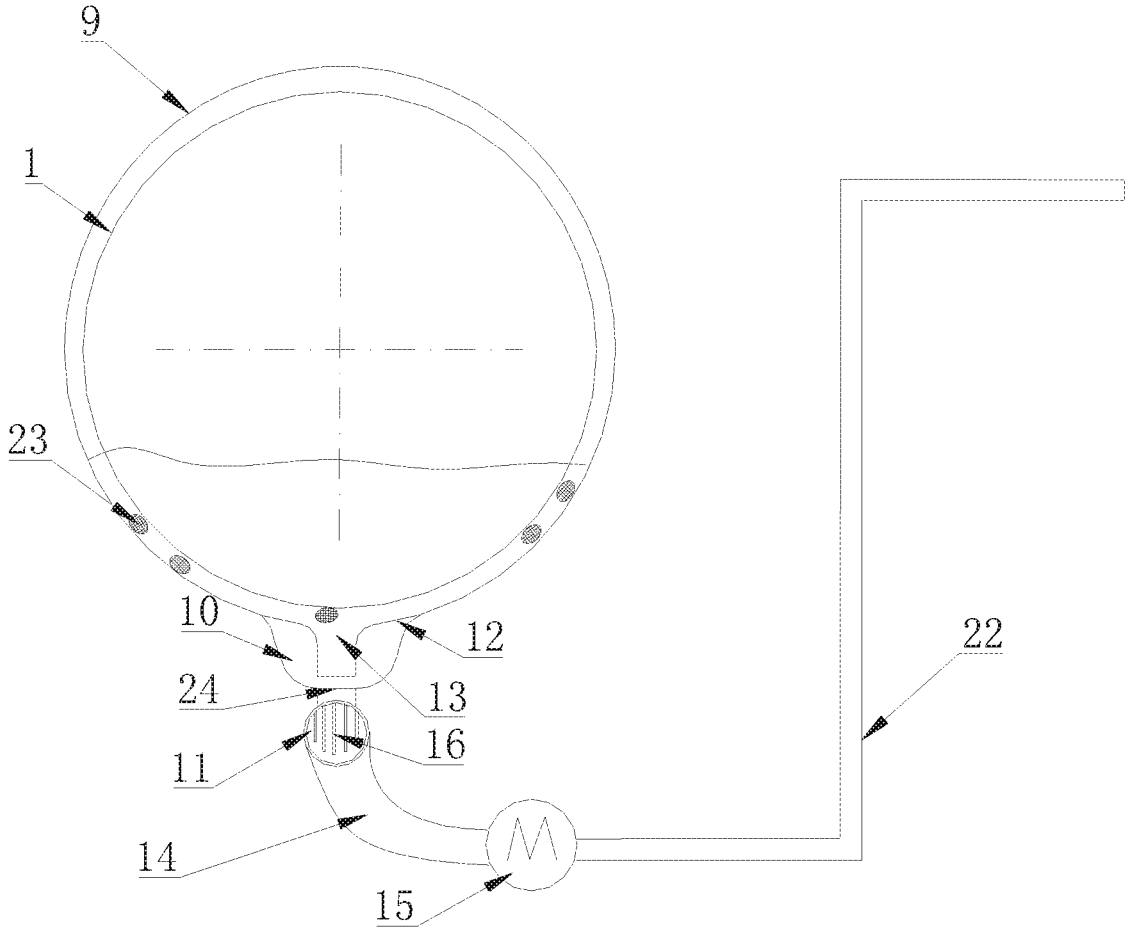
FIG. 3: A front view of the structure of the washing machine (without the shell) of the present disclosure.

Wherein: 1. Drum, 2. Flange, 3. Drum shaft, 4. Shaft hole, 5. Groove, 6. Sealing plate, 61. Screw hole, 62. Screw hole sealing ring, 63. Screw, 7. First sealing ring, 8. Second sealing ring, 9. Outer tub, 10. Heating tube chamber, 11. Collection chamber, 12. Cover plate, 13. Opening, 14. Drain hose, 15. Drain pump, 16. Baffle, 17. Heating tube, 18. Cabinet, 19. Door body, 20. Driving device, 21. Inlet pipe, 22. Drain pipe, 23. Cleaning particle, 24. Drainage port.

DETAILED DESCRIPTION OF THE INVENTION

The self-cleaning drum washing machine in the present disclosure, at least comprises a drum 1 and an outer tub 9 which are coaxially arranged. Cleaning particles are arranged between the drum 1 and the outer tub 9. The relative structure between the drum 1 and the outer tub 9 is a smooth structure. A portion between the drum 1 and the outer tub 9 is made into the smooth structure, thus the dirt is not easy to adhere. And cleaning particles are provided between the drum 1 and the outer tub 9. It is easy for cleaning particles to clean an outer wall of the drum and an inner wall of the outer tub. The smooth structure can avoid the accumulation of dirt caused by different bump structures where the cleaning particles cannot clean, and avoid the formation of the dirt on dead ends and the breeding of bacteria. It also avoids the contamination for clothing during washing clothes.

Embodiment 1

A flange 2 is arranged at a bottom of the drum 1, and the flange 2 is fixedly connected to the drum 1. An outer side of a drum 1 sidewall has a smooth structure, an outer portion of the flange 2 has a smooth structure. It is easier to deposit dirt on the flange as the flange usually has a rugged structure. Over time, the deposited dirt on the flange will be more and more. In the present embodiment, the cleaning particles are added between the drum and the outer tub. The flange generally has a complex structure and more corners, which is easy to lock clean particles, and edges and corners are also likely to damage the clean particles. In the present embodiment, the flange 2 is made into a smooth structure. An outer surface of the flange can be a smooth plane or a smooth curved surface that the dirt is not easy to adhere. And it is conducive for the clean particles to clean the outer wall of the flange. That can avoid the accumulation of dirt caused by the different bump structures where the cleaning particles cannot clean, and avoid the formation of the dirt dead ends, the breeding of bacteria, the contamination for clothing when washing clothes. That can avoid the rugged edges of the flange to lock the clean particles or damage the clean particles.

Embodiment 2

In the self-cleaning drum washing machine of the present disclosure, a flange 2 is arranged at a bottom of the drum 1, the flange 2 is fixedly connected to the drum 1. An enclosed cavity is arranged on an outer portion of the bottom of the drum. The flange 2 is arranged in the cavity, an outer wall of the cavity is a smooth structure. A shaft hole 4 is arranged at a center of the cavity; and a drum shaft 3 sticks into the cavity through the shaft hole 4 and connected to the flange 2.

The flange at the bottom of the drum is mostly triangular shape and is arranged on the outer portion of the bottom of the drum for connecting the drum and the drum shaft to enhance the strength of the drum. It avoids the damage on the drum by an account of excessive torque caused by direct connection of the drum and the drum shaft. The portion near the center of the flange is connected to the drum shaft, and the portion away from the center of the flange is connected to the drum. There is water between the drum and the outer tub during washing and rinsing processes. It is easier to deposit dirt on the flange as the flange is usually a rugged structure. Over time, the deposited dirt on the flange will be more and more. In the present embodiment the cleaning particles are added between the drum and the outer tub. The flange generally has a complex structure with more corners, which is easy to lock the clean particles, and edges and corners are also likely to damage clean particles.

An enclosed cavity is arranged on the outer portion of the bottom of the drum 1 of the present disclosure, the flange 2 is arranged in the cavity. The bottom of the drum is a smooth structure, which is not easy to adhere dirt, and is conducive for the clean particles to clean the outer wall of the drum.

The bottom of the drum 1 is a nonporous structure, which ensures that the cavity on the bottom of the drum 1 is sealed. A groove 5, which is recessed inside the drum 1, is arranged at the bottom of the drum, and the flange 2 is arranged in the groove 5. A sealing plate 6 is arranged at the opening of the groove 5, between the groove 5 and the sealing plate 6 is the enclosed cavity. A side facing outwardly of the seal plate 6 is a smooth plane or a smooth curved surface. In this way, the rugged flange can be enclosed in the groove 5, and the structure is simple and easy to install.

The sealing plate 6 is fixed to the flange 2 by screws. The sealing plate 6 is provided with a plurality of screw holes 61 on the circumference. The sealing plate is fixedly connected with the flange by the screw 63. A screw hole sealing ring 62 is provided between the screw 63 and the screw hole 61 to prevent the washing water from entering the enclosed cavity and to avoid the flange 2 being corroded and rusted by water after a long time of usage.

The flange 2 and the sealing plate 6 are integrally formed, preferably, one end face of the flange 2 extends into a flat plate to form the sealing plate 6. In this way, the flange 2 and the sealing plate 6 can be connected without a screw. That can completely avoid the leakage problem caused by the connection, and the installation process becomes simpler.

A first sealing ring 7 is arranged between the shaft hole 4 and the drum shaft 3, and the shaft hole 4 and the drum shaft 3 are movably sealed. The second sealing ring 8 is arranged between the sealing plate 6 and the opening of the groove 5. The sealing plate 6 and the opening of the groove 5 are static sealed. That can ensure that the washing water and the rinse water don't enter the enclosed cavity with the sealed structure and such structure extends the life of the drum.

The shape of the groove 5 is the same as the shape of the flange 2, the inner side of the bottom of the drum 1 has an inward bulge, which has the same shape with the flange 2. The shape of the flange has a middle with circular shape and a plurality of ribs radially distributed on the outer periphery, preferably three ribs. So that the inner side of the bottom of the drum 1 has a plurality of bulges radially distributed from the center. When the drum rotates, these protrusions are just able to play the role of lifting clothing. After being lifted to a certain height, the clothing falls off and are beaten and rubbed under the action of gravity, which can improve the cleaning ratio of clothing.

Alternatively, the bottom of the drum 1 is the nonporous structure, the outer side of the bottom of the drum 1 is a plane structure, the flange 2 is arranged at the outer side of the bottom of the drum 1. A basin-shaped shell is arranged on the outer portion of the flange 2, the opening of the shell is connected to the bottom of the drum 1 in a seal way. Between the shell and the drum 1 bottom is an enclosed cavity, and the shaft hole 4 matching with the drum shaft 3 is arranged at the center of the shell. The drum shaft 3 sticks into the cavity through the shaft hole and is connected to the flange 2. In the present structure, the bottom of the drum 1 is a plane structure, and the processing is simple, the processing technology is simple and easy to operate.

Embodiment 3

A washing machine having the above-mentioned drum of the present disclosure, comprises a drum 1, an outer tub 9 is arranged on the outside of the drum 1. Cleaning particles are arranged between the drum 1 and the outer tub 9. During washing and rinsing processes, the cleaning particles move in water, rub and collide against the outer wall of the drum 1 and the inner wall of the outer tub 9 to effectively clean the surfaces and to prevent stain deposition. The outer wall of the drum and the inner wall of the outer tub are both smooth structures. The smooth structure can greatly reduce the adhesion of dirt. Even with stains attached, the smooth structure is also easy to be cleaned. The structure will not form blind corners, and avoid the blind corners of stains to breed bacteria.

The inner side of the bottom of the outer tub 9 has a smooth plane or a smooth curved surface. Preferably, a heating tube chamber 10 is arranged at a lowest portion inside the outer tub. The heating tube chamber is a groove recessed downwardly in the vertical direction. A heating tube is arranged in the groove. A cover plate 12 is arranged at the opening of the groove, the side of the cover plate 12 towards the drum has a smooth plane or a smooth curved surface. The drum washing machine is provided with a heating tube 17 in the outer tub 9 to heat the washing water in order to increase the activity of enzyme containing detergent and to increase the cleaning ratio. The heating tube 17 is arranged at the lowest portion of the outer tub. However, if the cleaning particles are placed between the drum 1 and the outer tub 9, the cleaning particles are easily blocked by the heating tube. And the temperature of the heating tube is high, that will cause damage to the clean particles. Since the deposition of dirt is more likely to occur at the corners of the lower portion of the groove, a cover plate is provided on the heating tube chamber 10. The cover plate can effectively block the dirt from getting into the heating tube chamber 10, and prevent the cleaning particles from entering the heating tube chamber and contacting with the heating tube. Thus can avoid the heating tube being too high temperature to cause damage to the cleaning particles, but also blocks the lint from getting into the heating tube chamber 10 which could wrap around the heating tube, to avoid the impact of the lint on the heating tube.

The cover plate 12 is a metal plate with good thermal conductivity. The area between the cover plate 12 and the heating tube 17 is filled with water. And the area of the metal plate is significantly increased as compared with the contact area of the heating tube 17 and the water. It is equivalent that the metal plate indirectly heats the water inside the drum 1. The heating area is larger and the water temperature in the drum 1 is more uniform.

The cover plate 12 is provided with an opening 13 which communicates with an inside of the outer tub 9 and the heating tube chamber 10. The water in the outer tub 9 can enter the heating tube chamber 10 through the opening 13, and the heating tube heats the water inside. The cover plate 12 extends smoothly from the opening 13 downwardly to a position which has a distance from the bottom of the heating tube chamber 10. The water can enter into the heating tube chamber 10 through the gap formed by the distance. The distance is less than the minimum diameter of the cleaning particles 23, which can block the cleaning particles 23 from getting into the heating tube chamber 10.

A drainage port 24 is arranged at the lowest portion of the heating tube chamber 10, the cover plate 12 is located above the drainage port 24. The position of the opening 13 on the cover plate 12 corresponds to the position of the drainage port 24. The water in the outer tub 9 can directly get into the drainage port during a drainage process, which avoids the pipe having more turning which increases resistance. The cover plate 12 extends smoothly from the opening 13 downwardly to a position which has a distance from the drainage port 24. The distance is less than the minimum diameter of the cleaning particles, which can block the cleaning particles 23 from getting into the heating tube chamber 10.

A collection chamber 11 for collecting the cleaning particles is arranged at the drainage port 24. The collection chamber 11 communicates with the drain pump 15 through a drain hose 14. The drain pump 15 is connected to the drain pipe 22 of the washing machine. A bar-shaped baffle 16 is arranged between the collection chamber 11 and the drain hose 14 for blocking the cleaning particles from sliding into the drain hose. A gap between the bar-shaped baffles 16 is smaller than the minimum diameter of the cleaning particles, which can block the cleaning particles 23 from getting into the drain pump, and avoid the drain pump breaking the cleaning particles 23 or causing damage to the drain pump.

The foregoing description is only a preferred embodiment of the present disclosure. It should be pointed out that will be apparent to one skilled in the art that various modifications and improvements can be made therein without departing from the principles of the disclosure. This should also be regarded as a protection of the present disclosure.

The invention claimed is:

1. A self-cleaning drum washing machine, comprising:

a rotatable drum;

an outer tub coaxially arranged with the rotatable drum; and cleaning particles arranged between the rotatable drum and the outer tub, wherein:

an inner surface of the outer tub is a smooth surface, a drum rear of the rotatable drum is a nonporous structure, a recessed groove is arranged at the drum rear of the rotatable drum, and a flange is arranged at the drum rear of the rotatable drum in the recessed groove and connected to the rotatable drum, and a sealing plate is arranged at an opening of the groove to cover a whole of the drum rear of the rotatable drum, an enclosed cavity containing the flange is defined between the groove and the sealing plate, and an exterior side of the sealing plate has a smooth planar or a smooth curved surface.

2. The self-cleaning washing machine according to claim 1, wherein a shape of the groove is the same as a shape of the flange, and an inner side of the drum rear of the rotatable drum has an inward bulge being a same shape as the flange.

3. The self-cleaning washing machine according to claim 2, wherein a first sealing ring is arranged between a shaft hole and a rotatable drum shaft, and a second sealing ring is arranged between the sealing plate and the drum rear of the rotatable drum.

4. The self-cleaning washing machine according to claim 3, wherein an inner portion of the outer tub is a smooth plane or a smooth curved surface, a heating tube chamber is arranged at a lowest portion inside the outer tub, the heating tube chamber is a second groove recessed downwardly in a vertical direction, a heating tube is arranged in the second groove, and a cover plate is arranged at the opening of the second groove, a side of the cover plate towards the rotatable drum is a smooth plane or a smooth curved surface.

5. The self-cleaning washing machine according to claim 2, wherein an inner portion of the outer tub is a smooth plane or a smooth curved surface, a heating tube chamber is arranged at a lowest portion inside the outer tub, the heating tube chamber is a second groove recessed downwardly in a vertical direction, a heating tube is arranged in the second groove, and a cover plate is arranged at an opening of the second groove, a side of the cover plate towards the rotatable drum is a smooth plane or a smooth curved surface.

6. The self-cleaning washing machine according to claim 1, wherein the sealing plate is fixed to the flange by screws, or the flange and the sealing plate are integrally formed.

7. The self-cleaning washing machine according to claim 6, wherein a first sealing ring is arranged between a shaft hole and a rotatable drum shaft, and a second sealing ring is arranged between the sealing plate and the drum rear of the rotatable drum.

8. The self-cleaning washing machine according to claim 6, wherein an inner portion of the outer tub is a smooth plane or a smooth curved surface, a heating tube chamber is arranged at a lowest portion inside the outer tub, the heating tube chamber is a second groove recessed downwardly in a vertical direction, a heating tube is arranged in the second groove, and a cover plate is arranged at the opening of the second groove, a side of the cover plate towards the rotatable drum is a smooth plane or a smooth curved surface.

9. The self-cleaning washing machine according to claim 6, wherein one end face of the flange extends into a flat plate to form the sealing plate.

10. The self-cleaning washing machine according to claim 6, wherein a shaft hole matching with a rotatable drum shaft is arranged at a center of the sealing plate, and the rotatable drum shaft sticks into the cavity through the shaft hole and is connected to the flange.

11. The self-cleaning washing machine according to claim 1, wherein an inner portion of the outer tub is a smooth plane or a smooth curved surface, a heating tube chamber is arranged at a lowest portion inside the outer tub, the heating tube chamber is a second groove recessed downwardly in a vertical direction, a heating tube is arranged in the second groove, and a cover plate is arranged at an opening of the second groove, a side of the cover plate towards the rotatable drum is a smooth plane or a smooth curved surface.

12. The self-cleaning washing machine according to claim 11, wherein the cover plate is provided with an opening communicating with an interior of the outer tub and the heating tube chamber, the cover plate extends smoothly from the opening downwardly to a position which has a distance from a bottom of the heating tube chamber, and the distance is less than a minimum diameter of the cleaning particles.

13. The self-cleaning washing machine according to claim 12, wherein a drainage port is arranged at the lowest portion of the heating tube chamber, the cover plate is located above the drainage port, a position of the opening on the cover plate corresponds to a position of the drainage port, the cover plate extends smoothly from the opening downwardly to a position which has the distance, the distance is less than the minimum diameter of the cleaning particles.

14. The self-cleaning washing machine according to claim 11, wherein the cover plate is a metal plate with thermal conductivity.

* * * * *